US005704841A

United States Patent [19]

Checketts

[11] Patent Number: 5,704,841

[45] Date of Patent: Jan. 6, 1998

[54] DEVICE FOR ACCELERATING AND DECELERATING OBJECTS

[76] Inventor: Stanley J. Checketts, 900 E. Canyon Road, Providence, Utah 84332

[21] Appl. No.: 698,124

[22] Filed: Aug. 15, 1996

[51] Int. Cl.[6] ..... A63G 31/10

[52] U.S. Cl. ..... 472/131; 472/50

[58] Field of Search ..... 472/49, 50, 131, 472/134, 136, 137; 482/69

[56] References Cited

U.S. PATENT DOCUMENTS

| | | | |
|---|---|---|---|
| 1,991,459 | 2/1935 | Heimers | 472/131 X |
| 2,221,215 | 11/1940 | Eyerly | 472/50 |
| 2,229,201 | 1/1941 | Williford | 472/50 |
| 3,587,397 | 6/1971 | Hagopian | 91/399 |
| 3,701,528 | 10/1972 | Ryan | 472/131 |
| 3,949,953 | 4/1976 | Hopkins | 243/3 |
| 4,487,410 | 12/1984 | Sassak | 434/55 |
| 4,545,574 | 10/1985 | Sassak | 472/131 |
| 5,417,615 | 5/1995 | Beard | 472/50 |
| 5,597,358 | 1/1997 | Marcu | 472/50 |
| 5,628,690 | 5/1997 | Spieldiener et al. | 472/131 |
| 5,632,686 | 5/1997 | Checketts | 472/131 |

*Primary Examiner*—Kien T. Nguyen
*Attorney, Agent, or Firm*—Thompson E. Fehr

[57] ABSTRACT

A device for accelerating and decelerating objects by introducing compressed gas into the bore of a housing. A piston is slidably mounted in the bore and has attached to it a cable which proceeds along the bore, through a first aperture near the first end of the housing, around a first pulley, along the exterior of the housing, around a second pulley, through a second aperture near the second end of the housing, and along the bore again before entering the piston and having the second end of the cable connected to the first end of the cable. A carrier is attached to the cable so that the carrier is near the second end of the housing when the piston is near the first end of the housing. Compressed gas can be introduced into the bore near the first end of the housing or near the second end of the housing. An exhaust valve located between the first end of the housing and the second end of the housing can be opened or closed, and a deceleration control valve located near the first end of the housing and closer to the first end of the housing than the exhaust valve can be adjusted. By selectively injecting compressed gas into the bore at the two locations and by controlling the exhaust valve and the deceleration control valve, at least five modes of oscillation may be achieved.

34 Claims, 2 Drawing Sheets

DEVICE FOR ACCELERATING AND DECELERATING OBJECTS

BACKGROUND OF THE INVENTION

1. Field of the Invention

This invention relates to a device and method for using fluid dynamics to accelerate and decelerate an object, especially a participant on an amusement device commonly termed an amusement ride.

2. Description of the Related Art

In the sport of bungee jumping a participant usually ascends a tower, walks onto a bridge, is hoisted in a basket by a tower crane, or is lifted aloft in the gondola of a hot air balloon with a resilient band, i.e., a bungee cord, attached to the participant's body and to the tower, bridge, basket, or gondola. The participant then leaps from the tower, bridge, basket, or gondola and, because of the interactions between the force of gravity and the elastic force of the band, undergoes a series of basically vertical oscillations. Dampening produced by air friction and losses of energy within the band causes the oscillations to cease within a relatively short period of time. The participant is then lowered to the earth.

An initial device to capture the freedom and exhilaration of bungee jumping with increased safety and rapidity of repeating the experience is described in U.S. Pat. No. 5,203,744 of Stanley J. Checketts. The device consists basically of a tower which participants may ascend by using a stairway or escalator, arms branching from the tower having open ends from which a participant attached to a resilient band may leap, and a winch to lower the participant to the earth after the oscillations induced by the initial leap have subsided and to restore the resilient band to its original location after it has been detached from the participant. The speed with which this experience may be repeated is, however, limited by two factors—the time it takes the participant to ascend the tower and the imprudence of using each resilient band to handle more than one participant at a time.

Theoretically, more than one participant could simultaneously be elevated and then oscillated on the amusement device discussed in U.S. Pat. No. 2,221,216 of Lee U. Eyerly. But the practical capacity of Eyerly's car is severely limited by the fact that the springs or rubber bands essential to producing the oscillations are connected directly to a rigid member that pushes the bottom of the car and must, therefore, be vertically mounted. To generate sufficient force for vertically accelerating a platform capable of carrying more than a few participants requires large and, consequently, heavy springs or resilient bands. When installed vertically, their own weight impairs the resiliency of these springs or bands.

Another device which can produce vertical oscillations of multiple participants is the subject of U.S. Pat. No. 1,991,459, which was issued to Rudolf Heimers. Such device simply utilizes the muscular power of the participants to raise or lower a carrier that is suspended from a rope which winds around a flywheel that has an eccentrically arranged weight. The initial movement will cause the flywheel cyclically to wind and unwind the rope, thereby oscillating the participants. Since these oscillations are produced by the muscular power of the participants, the oscillations will require a rather lengthy period to reach reasonable amplitudes; and the attendant acceleration and deceleration will be rather limited in magnitude.

The amusement device described in U.S. Pat. No. 3,701,528 of Jerry E. Ryan consists of a vertical tower having eight outwardly extending horizontal arms. A participant can be suspended with a cable from a pulley attached to one of the horizontal arms. The participant is raised by filling a bucket attached to the other end of the cable with an adequate supply of water to act as a counterweight. Raising a removable weight from the bucket causes the participant slightly to outweigh the bucket of water then forming the counterweight so that the participant experiences a perceived reduced positive gravitational force. The device of U.S. Pat. No. 3,701,528 cannot, however, create a perceived negative (upward) gravitational force. Its operation, furthermore, requires a considerable period of time since each horizontal arm cannot simultaneously handle more than one participant and since the required movement of water will be quite consumptive of time. And the only oscillations which appear to be possible are produced by the participant jumping upward from the ground after gravity has returned such participant to the ground subsequent to the initial ascent, which was produced by mass of the water plus the removable weight.

The amusement apparatus which is the subject of U.S. Pat. No. 2,229,201 to Marsh E. Williford and Clarence E. Partee can, during a limited portion of its deceleration, produce a perceived negative gravitational force. A carrier (car) is winched up a tube. The carrier is then allowed to drop. As the carrier falls, it breaks a beam of light to an electric eye, which energizes some solenoid coils that attract metal on the carrier thereby producing a downward force in addition to that of gravity. The participants in the carrier are not restrained and, consequently, appear to rise above the bottom of the carrier. (Although the patent does not refer to any deactivation of the solenoid coils, such coils would act as a decelerating force as soon as the carrier dropped below them if such coils were not deactivated.) The participants remain above the floor of the carrier until the downward acceleration becomes less than that produced by gravity. Deceleration is apparently produced by friction; air resistance; a second set of solenoid coils; an optional brake on the winch; and, if necessary, a pneumatic braking systems consisting of vents of graduated size located near the bottom of the tube, which vents permit air to escape rapidly at first, then more slowly, and then not at all.

In the Williford invention, the carriers is always inside the tube; there is no oscillation; and the downward force appears to be of quite limited duration, certainly not being present at the beginning of the downward movement.

All five of the preceding inventions are, moreover, limited to functioning in a basically vertical direction.

In U.S. Pat. application Ser. No. 08/324,759 of Stanley J. Checketts compressed air is injected between a first end of a housing and a piston which is slidably mounted in the bore of the housing. A cable attached to the side of the piston that is toward the first end of the housing travels through an aperture near the first end of the housing before passing over a first pulley and then connecting to a carrier which hold the object or objects. The cable is selected to be of a length such that the piston will not exit the open end of the bore, which is opposite to the first end of the housing. This creates the possibility of operating the pneumatic device in two different modes. In the first mode, the pressure of the introduced gas is insufficient to propel the objects past the side of the first pulley that is opposite to the initial location of the objects. The force of the introduced gas accelerates the piston away from the end of the bore near the aperture, subsequently decelerates the piston after it has changed direction, and then begins the cycle again. When a greater pressure is utilized, the gas will accelerate the piston and the objects until they pass the first pulley; then decelerate the objects until they stop beyond the first pulley; subsequently accelerate the objects toward the first pulley, creating a perceived negative gravitational force if the movement is vertical; and then decelerate the objects after they have again passed the first pulley.

As the objects pass the first and second pulleys, the piston almost instantaneously must change its direction of travel. This puts considerable strain on the cable as well as on the piston and the carrier. Furthermore, because the cable and piston do not form a continuous loop, differences in momentum between the carrier and the piston when the piston changes its direction of travel can momentarily cause the cable to become slightly slack.

The carrier (vehicle) in U.S. Pat. No. 5,417,616 of Terry D. Beard has its direction of travel controlled by a guide cable. Compressed air flows into the bottom of an acceleration tube to eject the carrier. At the upper end of the guide cable, an emergency deceleration tube provides pneumatic braking. From line 68 of column 3 to line 6 of column 4 the patent declares, "The deceleration tube's circumference is somewhat greater than that of the vehicle, allowing some of the air to be squeezed out along the vehicle's sides. This prevents the pressure above the vehicle from building up too rapidly and bringing the vehicle [to]an uncomfortably abrupt stop." The deceleration tube may, also, incorporate a pressure relief valve. Between lines 10 and 17 of column 4 the patent continues, "Once the vehicle 10 has reached the upper limit of its travel, it begins to fall back down along the guide cable 6. Upon its re-entry into the acceleration tube 8, the air pressure within the tube below the vehicle rapidly builds up as the vehicle travels further into the tube. The relief valves 38 are set to assure a smooth deceleration."

There is no provision in the invention of the Beard patent for having the carrier rise slowly, nor is there any downward force other than gravity. There are no oscillations since there is no provision for a rebound; the carrier is simply ejected, rises until it stops, and then falls back into the acceleration tube where the carrier's downward movement is ultimately smoothly terminated. The disclosure is directed solely to a vertical operation. Only for the initial acceleration could a gas other than are be utilized. And the carrier is within one or more tubes for a substantial portion of its motion.

The invention in U.S. Pat. No. 4,487,410 of John J. Sassak merely involves a spherical carrier (passenger-holding body) which has a diameter slightly smaller than that of a tube. A turbine forces air into the bottom of the tube, raising the carrier.

In the device of this first Sassak patent there is no downward force other than gravity. The only time the carrier is even partially outside the tube is when the carrier has risen to the top of the tube. No oscillations occur because there is no provision for rebounding. There is no discussion of a cushioned stop when the turbine is deactivated. The claims refer to the use of a fluid for raising the carrier, although only air is disclosed. And the tube would only work as described if it is essentially vertical; moreover, the tube is disclosed and claimed to have an upper opening and a lower opening.

The second Sassak patent is U.S. Pat. No. 4,545,574. The device of this patent is the same as that of the first Sassak patent with the exception that the turbine draws air from the top of the tube rather than pushing air into the bottom of the tube. In this second Sassak patent, the only the time the carrier is outside the tube is when the carrier is being drawn into the bottom of the tube.

A number of patents outside the field of amusement rides also employ features relevant to the patentability of the present Device for Accelerating and Decelerating Objects.

U.S. Pat. No. 5,447,221 of Carlos A. Sors concerns a Pneumatic Elevator by Depressure. A carrier (cab) is raised within a tube by the creation of suction at the top of the tube. Deceleration is produced by decreasing the vacuum above the carrier; a valve is opened which allows air to enter the tube at a rate which causes the carrier to descend at a speed of one meter per second. The rate of deceleration is not achieved by the rate at which air flows from the tube; the patent states on lines 36 through 37 of column, ". . . the air will flow out freely through the lower intake or opening . . ."

The tube of the Sors patent is oriented vertically. There is no downward force other than gravity. No gas other than air could be successfully employed. No rebounding of the carrier is achieved through compression and expansion of a gas. And the carrier travels exclusively within the vertical tube.

A carrier (transporter) is raised inside a shaft from a lower horizontal level to the top of the shaft with pressurized air supplied below the carrier by compressors in the invention for U.S. Pat. No. 3,949,953 of Leslie A. Hopkins. The top of the shaft incorporates restraining means to hold the carrier at that position. And a non-return valve precludes air from leaving the bottom of the shaft, thereby limiting the speed of deceleration under emergency conditions.

The Hopkins patent employs no downward force in addition to gravity. No rebounding produced by compression and expansion of a gas appears to be either intended or discussed; but when the non-return valve operates, there may be an unintended rebound unless there is significant leakage of air. Moreover, a compressor may not be able to create a rapid acceleration, which, in any event, would probably be undesirable for the stated primary purpose of transporting mined material. The carrier is always confined to the inside of the shaft. Although the claims dealing solely with the carrier term such carrier "a fluid transporter," only air from compressors is disclosed as the medium for transmitting the propulsive force. And only a vertical shaft or duct is disclosed; when a duct is claimed, it is designated as an "upright duct."

Cushioning of the impact of a piston in an effect similar to that produced on the carrier by the graduated vents of the Williford invention and the deceleration tube of the Beard patent is achieved through a slightly different technique in the device covered by U.S. Pat. No. 3,587,397 of Berge Hagopian. The Hagopian patent is, however, the only one of the three that is explicitly intended to prevent rebounding. Within a single pneumatic cylinder gas pressure is applied to one face of a piston to accelerate the piston for a portion of a stroke, whereupon the piston reaches an area in which a portion of the bore of the cylinder is enlarged to permit gas to pass around the piston to equalize the pressure on both sides of the piston. Momentum of the piston then carries it into a region where the bore has its original dimensions. Compression of the gas in front of the moving piston next decelerates the piston. Rebounding of the piston is prevented by allowing gas to pass, at a controlled rate, through an orifice leading from the substantially closed end of the cylinder toward which the piston has been accelerated.

No suggestion exists, though, that the device of U.S. Pat. No. 3,587,397 could be utilized in an amusement ride; and this device is designed solely to preclude the piston from rebounding.

The third prior-art patent of John J. Sassak is U.S. Pat. No. 4,997,060. A carrier (gondola) is inside a chute. The chute has an air vent at its upper end and an air vent at its lower end. An air motor can force air through the lower vent. When the air motor brings air into the chute below the carrier, the carrier is raised. For a deceleration, the carrier falls under the force of gravity. The rate of deceleration can be increased by removing air from below the carrier with the air motor. The rate of deceleration can be reduced by closing the upper vent to create a vacuum above the carrier, by closing the lower vent, or by using the air motor to bring additional air into the chute below the carrier.

The device of this third Sassak patent is operated only with air; is primarily intended for removing the occupants of a high-rise building during an emergency; and, according to lines 66 and 67 in column 2, has a generally vertical shaft or chute. It is doubtful that an air motor could produce the rapid acceleration which can be achieved through the introduction of a pressurized gas. No rebound appears to be intended or discussed; but if the lower vent is closed during deceleration of the carrier, it is difficult to determine how an unintended rebound would be avoided. Moreover, the carrier never leaves the chute.

SUMMARY OF THE INVENTION

The present Device for Accelerating and Decelerating Objects enables many participants to utilize the Device simultaneously; can rapidly change participants so that many participants can be accommodated within a given period of time; has the option for either rapid acceleration or gradual movement in its initial direction of motion; can cause the participant either to rebound or have a cushioned stop at the end of travel in either direction; can be placed in any orientation, except when the Device is desired to be operated in a free-fall mode; can provide an immediate and lengthy force in addition to that of gravity to create a perceived negative gravitational force whenever the participant is moving toward the earth; always maintains the participant outside the cylinder so that, when used as an amusement ride, the Device enhances the participant's experience with its visual impact; has a continuous cable so that such cable does not even momentarily go slack; and causes no sudden change in the direction of its piston, which could create a strain on the cable, piston, or carrier.

This is accomplished with structure including a piston slidably mounted within the bore of a housing. The housing has a first aperture near the first end of the housing and a second aperture near the second end of the housing. The first end of a cable is attached to the piston before the cable proceeds from the side of the piston which is nearer the first end of the housing, along the bore of the housing, through the first aperture, along the exterior of the housing, through the second aperture, and again along the bore of the housing until the cable enters the piston from the side of the piston which is farther from the first end of the housing and the second end of the cable is attached to the first end of the cable.

The first aperture and the second aperture are both constructed large enough to permit the cable to pass freely but small enough that the quantity of gas which escapes through the first aperture and the second aperture will not preclude the desired operation of the Device for Accelerating and Decelerating Objects. If losses of gas are desired to be decreased further, the cable can be coated with a substance, such as nylon, to create a smooth surface.

To assist in orienting the cable and to reduce frictional forces, the cable-after exiting the first aperture but before proceeding along the exterior of the housing-preferably passes around a first pulley or other friction-reducing device which can alter the direction of the cable, such as a bearing. Similarly, before entering the second aperture and after proceeding along the exterior of the housing, the cable preferably passes around a second pulley or other friction-reducing device which can alter the direction of the cable.

One or more objects, especially including participants, are attached to the cable directly or, preferably, may be placed on a carrier which is attached directly to the cable.

The position for attachment of the carrier or object to the cable is selected so that the carrier or object will be near the second end of the housing when the piston is near the first end of the housing and, consequently, so that the carrier or object will be near the first end of the housing when the piston is near the second end of the housing.

A container for pressurized gas is connected, through a first input valve, to the housing near the first end of such housing and communicates there with the bore of the housing. Preferably such first input valve is a check valve which permits gas to flow from the container into the bore of the housing but not from the bore of the housing into the container. The container for pressurized gas is, also, preferably connected, through a second input valve, to the housing near the second end of such housing and communicates there with the bore of the housing. Such second input valve is preferably a check valve which permits gas to flow from the container into the bore of the housing but not from the bore of the housing into the container.

A deceleration control valve is connected to the housing and communicates with the bore of the housing near the first end of said housing but sufficiently far from such first end of said housing that the quantity of gas between said deceleration control valve and the first end of the housing would be adequate to bring the piston to a cushioned stop should such deceleration control valve stick in a fully open position. Preferably the location of the deceleration control valve will also be sufficiently close to the first end of the housing that the quantity of gas between said deceleration control valve and the first end of the housing will be sufficiently small to minimize rebounding of the piston.

An exhaust valve is attached to the housing and communicates with the bore of the housing between the deceleration control valve and the position of the piston at the closest approach of said piston to the second end of the housing.

The present Device for Accelerating and Decelerating Objects may be operated in at least five modes.

Only the first mode requires a specific orientation of the Device. This orientation simply requires the first end of the housing to be higher than the second end of the housing. For all modes, however, the preferred orientation is with the first end of the housing approximately directly above the second end of the housing, which is a vertical orientation.

In the first mode, which for mnemonic convenience is termed the "free-fall" mode, initially the deceleration control valve is closed; and the exhaust valve is open. The first input valve is then adjusted to introduce gas at a moderate rate into the bore of the housing near the first end of said housing. This gas forces the piston toward the second end of the housing and, consequently, the participant toward the first end of the housing. With the exhaust valve open, gas may exit from the bore of the housing as the piston is pushed toward the exhaust valve. As the piston passes the exhaust valve, the exhaust valve is closed; and gas continues to be introduced into the housing until the participant has reached a desired height. The exhaust valve is then opened, allowing the weight of the participant to push the piston toward the first end of the housing and the participant to descend. The deceleration control valve is adjusted to allow gas to escape at such a rate as gives the desired deceleration speed for the participant once the piston has reached the exhaust valve on the piston's journey toward the first end of the housing. In this mode, the deceleration control valve is also adjusted so that rebounding of the piston and, consequently, the participant is minimized.

The second mode is, for mnemonic purposes, termed the "boost and stop" mode. In this mode the process is identical to that of the "free-fall" mode until the participant reaches the desired distance from the first end of the housing, which in the "free-fall" mode was equivalent to height—a fact which is not necessarily true in this case because the second mode may be employed in any orientation of the Device. Once the participant has reached the desired distance from the first end of the housing, gas is rapidly injected into the bore of the housing through the second input valve and the exhaust valve is opened. The expansion of the introduced gas then pushes the piston rapidly toward the first end of the housing. (If the Device is at least relatively vertically oriented, the downward acceleration will initially, and for some time after the piston has passed the exhaust valve, be greater than the acceleration of gravity, thereby producing a sustained perception of a negative (upward) gravitational force.) Gas between the piston and the first end of the housing may exit through the exhaust valve until the piston reaches the exhaust valve. Just as in the "free-fall" mode, the deceleration control valve is adjusted to allow gas to escape at such a rate as gives the desired deceleration speed for the participant once the piston has reached the exhaust valve on the piston's journey toward the first end of the housing. In this mode, the deceleration control valve is also adjusted so that rebounding of the piston and, consequently, the participant is minimized.

The mnemonic term for the third mode is the "boost and rebound" mode. The process for the "boost and rebound" mode is the same as that for the "boost and stop" mode except that the deceleration control valve is kept closed so that as the piston approaches the first end of the housing, the kinetic energy of the piston and the participant (as well as the weight of the participant—and of the carrier, if a carrier is utilized—when the first end of the housing is higher than the second end of the housing) is used to compress gas between the piston and the first end of the housing until such kinetic energy has been depleted and the piston has stopped. Then the gas will expand, forcing the piston toward the second end of the housing and the participant toward the first end of the housing. Because of the energy lost when gas escapes through the exhaust valve, it is unlikely that there will be sufficient remaining kinetic energy for the piston to compress gas in the second end of the housing. If, however, the first end of the housing is higher than the second end of the housing, the weight of the participant—and of the carrier, if one is employed—will subsequently force the piston again toward the first end of the housing where subsequent compression and expansion of the gas will produce another rebound; and the oscillations will continue until either energy losses preclude the expanding gas from having sufficient energy to overcome the weight of the participant—and of the carrier, if one is employed—or the deceleration control valve is opened sufficiently to end the rebounding while still producing a cushioned stop.

"Enhanced boost and rebound" mode is the mnemonic term for the fourth mode. This mode differs from the "boost and rebound" mode only in that (1) the exhaust valve is never opened, in order to avoid the substantial loss of energy which occurs when gas exits the bore of the housing through the exhaust valve, and (2) the compressed gas is inserted into the second end of the housing at a higher pressure than in the "boost and rebound" mode—primarily because, with the exhaust valve maintained in a closed position, the pressure on the side of the piston toward the first end of the housing will generally be greater than the atmospheric pressure which exists with the exhaust valve open. Without the losses of energy through the exhaust valve, compression and expansion of gas will occur in the second end of the housing as well as in the first end of the housing for a substantial period. of time, i.e., until the smaller losses of energy within the system deplete the total energy of the system to the point that perceptible compression does not occur, or until the deceleration control valve is opened and adjusted to produce a cushioned stop of the piston. Furthermore, in this "enhanced boost and rebound" mode, repeated oscillations will occur even if the Device for Accelerating and Decelerating Objects is horizontally oriented, i.e., if the first end of the housing is at the same elevation as the second end of the housing.

Finally, the fifth mode is termed the "initial boost" mode. In this mode the exhaust valve continuously remains open. The deceleration control valve is initially closed. Such a large quantity of compressed gas is so rapidly injected through the first input valve into the bore at the first end of the housing that the piston so quickly passes the exhaust valve that significant gas remains between the piston and the second end of the housing and the kinetic energy of the system is so great that the piston compresses the gas in the second end of the housing until such kinetic energy is exhausted and the pressure in the second end of the housing combined with any component of weight from the participant—and the carrier, if a carrier is used—which is parallel to the bore of the housing and directed toward the second end of the housing forces the piston toward the first end of the housing, where compression and expansion of the gas again occurs. The oscillations produced by the repeated compression and expansion of gas in the first end and the second end of the housing continue until the losses of energy within the system deplete the total energy of the system to the point that perceptible compression does not occur, or until the deceleration control valve is opened and adjusted to produce a cushioned stop of the piston.

Of course, if a Device for Accelerating and Decelerating Objects is desired to be operated only in the "enhanced boost and rebound" mode, the exhaust valve could be eliminated because it is never opened in that mode.

Similarly, if a Device for Accelerating and Decelerating Objects is to be operated only in the "initial boost" mode, the exhaust valve could be replaced with an aperture because the exhaust valve remains open continuously in that mode; and the connection of the container for pressurized gas to the second end of the housing through the second input valve could be eliminated since, in the "initial boost" mode, gas is not injected into the second end of the housing. For this same reason the connection of the container for pressurized gas to the second end of the housing through the second input valve could be eliminated in the "free-fall" mode if the Device were to be used only for that mode or that mode and the "initial boost" mode.

Additionally, whenever a rebound is desired—at either the first end of the housing or at the second end of the housing— additional gas could be injected at the end where the rebound is desired both to increase the distance that the piston and, consequently, the participant—and the carrier, if a carrier is used—would rebound and to increase the number of rebounds which occur.

DESCRIPTION OF THE PREFERRED EMBODIMENT

Figure 1:
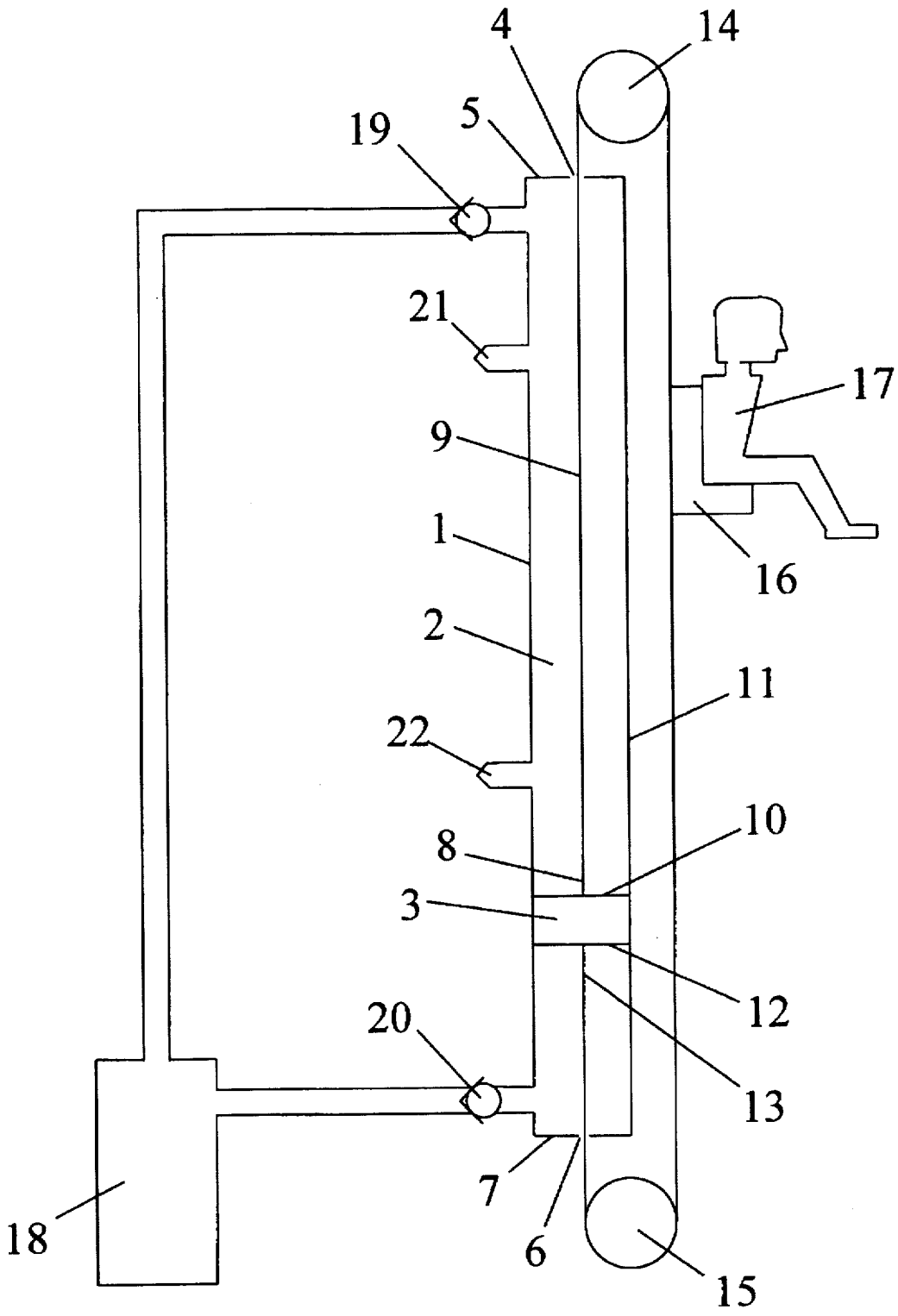
FIG. 1 shows the basic preferred embodiment of the Device for Accelerating and Decelerating Objects.

As illustrated in FIG. 1, the preferred embodiment of the Device for Accelerating and Decelerating Objects has a housing 1 containing a bore 2. A piston 3 is slidably mounted within the bore 2 and can travel freely along the length of said bore 2.

The housing 1 has a first aperture 4 near the first end 5 of the housing 1 and a second aperture 6 near the second end 7 of the housing 1. The first end 8 of a cable 9 is attached to the piston 3 before the cable 9 proceeds from the side 10 of the piston 3 which is nearer the first end 5 of the housing 1, along the bore 2 of the housing 1, through the first aperture 4, along the exterior 11 of the housing 1, through the second aperture 6, and again along the bore 2 of the housing 1 until the cable 9, enters the piston 3 from the side 12 of the piston 3 which is farther from the first end 5 of the housing 1 and the second end 13 of the cable 9 is attached to the first end 8 of the cable 9.

The first aperture 4 and the second aperture 6 are both constructed large enough to permit the cable 9 to pass freely but small enough that the quantity of gas which escapes through the first aperture 4 and the second aperture 6 will not preclude the desired operation of the Device for Accelerating and Decelerating Objects. As mentioned above, if losses of gas are desired to be decreased further, the cable 9 can be coated with a substance, such as nylon, to create a smooth surface.

To assist in orienting the cable 9 and to reduce frictional forces, the cable 9—after exiting the first aperture 4 but before proceeding along the exterior 11 of the housing 1—preferably passes around a first pulley 14 or other friction-reducing device which can alter the direction of the cable, such as a bearing. Similarly, before entering the second aperture 6 and after proceeding along the exterior 11 of the housing 1, the cable 9 preferably passes around a second pulley 15 or other friction-reducing device which can alter the direction of the cable 9.

A carrier 16 to hold one or more participants 17 is attached to the cable 9 in such a manner that the carrier 16 will be near the second end 7 of the housing 1 when the piston 3 is near the first end 5 of the housing 1 and, consequently, so that the carrier 16 will be near the first end 5 of the housing 1 when the piston 3 is near the second end 7 of the housing 1.

A container for pressurized gas 18 is connected, through a first input valve 19, to the housing 1 near the first end 5 of such housing 1 and communicates there with the bore 2 of the housing 1. Preferably such first input valve 19 is a check valve which permits gas to flow from the container 18 into the bore 2 of the housing 1 but not from the bore 2 of the housing 1 into the container 18. The container for pressurized gas 18 is, also, preferably connected, through a second input valve 20, to the housing 1 near the second end 7 of such housing 1 and communicates there with the bore 2 of the housing 1. Such second input valve 20 is preferably a check valve which permits gas to flow from the container 18 into the bore 2 of the housing 1 but not from the bore 2 of the housing 1 into the container 18.

A deceleration control valve 21 is connected to the housing 1 and communicates with the bore 2 of the housing 1 near the first end 5 of said housing 1 but sufficiently far from such first end 5 of said housing 1 that the quantity of gas between said deceleration control valve 21 and the first end 5 of the housing 1 would be adequate to bring the piston 3 to a cushioned stop should such deceleration control valve 21 stick in a fully open position. Preferably the location of the deceleration control valve will also be sufficiently close to the first end 5 of the housing 1 that the quantity of gas between said deceleration control valve 21 and the first end 5 of the housing 1 will be sufficiently small to minimize rebounding of the piston 3.

An exhaust valve 22 is attached to the housing 1 and communicates with the bore 2 of the housing 1 between the deceleration control valve 21 and the position of the piston 3 at the closest approach of said piston 3 to the second end 7 of the housing 1.

The Device for Accelerating and Decelerating Objects functions in at least five modes, as described above in the Summary of the Invention.

Figure 2:
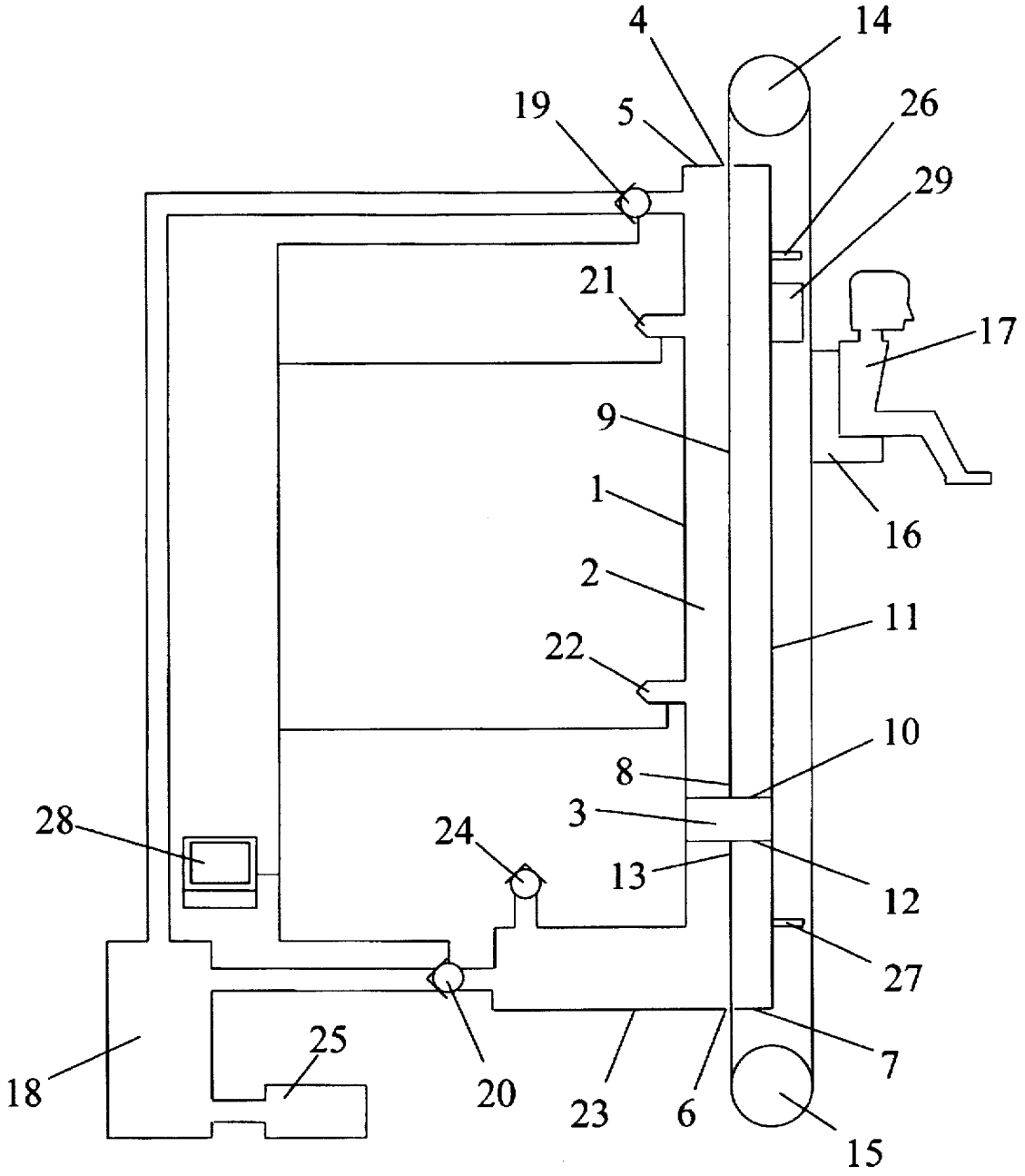
FIG. 2 adds to the embodiment of FIG. 1, an extension to increase the volume of the bore at the second end of the housing, a check valve to allow air to flow into such extension, a compressor, stops for the carrier, a computer, and a retention means.

Several optional preferred components for the Device for Accelerating and Decelerating Objects are illustrated in FIG. 2.

To decrease the tendency to have a reduction in gas pressure created in the bore 2 at the second end 7 of the housing 1 as the piston 3 moves away from the second end 5 of the housing 1, which reduction would, itself, tend to diminish the acceleration of the piston 3, an extension 23 is added to the housing 1 in order to increase the volume of the bore 2 at said second end 7 of the housing 1. And to assure that the pressure of the gas in the bore 2 at said second end 7 of the housing 1 is never below atmospheric pressure, a check valve 24, which communicates with both the atmosphere and the bore 2 is connected to said extension 23 so that air can flow from the atmosphere into the bore 2 within extension 23 but not from the bore 2 within extension 23 into the atmosphere.

Preferably, the gas utilized within the Device for Accelerating and Decelerating Objects is air. Therefore, a compressor 25 is attached to and communicates with the container for pressurized gas 18 to take air from the atmosphere, compress such air, and supply such pressurized air to the container 18.

To assure that the carrier 16 does not approach any nearer than is desired to the first end 5 of the housing 1, a first stop 26 is attached to the housing 1 near the first end 5 of the housing 1. Likewise, to guarantee that the carrier 16 does not approach any nearer than is desired to the second end 7 of the housing 1, a second stop 27 is connected to the housing 1 near the second end 7 of the housing 1. (If the housing 1 is placed within a support structure, the first stop 26 and the second stop 27 would be attached to such support structure rather than being directly connected to the housing 1; and the carrier 16 would move along the exterior of such support structure. In fact, the support structure, itself, would preferably constitute the second stop 27.)

The first input valve 19, the second input valve 20, the deceleration control valve 21, and the exhaust valve 22, are preferably controlled by a computer 28, which is electrically connected to such first input valve 19, such second input valve 20, such deceleration control valve 21, and such exhaust valve 22.

Also preferably, one or more of any of the types of retention means 29 which are well known in the art (such as a brake which forces friction pads against the carrier 16) are connected to the housing 1 near the first end 5 of the housing 1 to retain the carrier 16 at the location of the retention means 29 and thereby enhance the anticipation of the participant or participants 17 prior to the initial introduction of gas through the second input valve 20 in the "boost and stop" mode, the "boost and rebound" mode, and the "enhanced boost and rebound" mode and prior or even subsequent to the opening of the exhaust valve 22 after the participant or participants have reached the desired height in the "free-fall" mode.

I claim:

1. A device for accelerating and decelerating one or more objects, which comprises:

a housing containing a bore, having a first aperture near the first end of said housing, and having a second aperture near the second end of said housing;

a piston slidably mounted within the bore of said housing;

a cable to which the object or objects can be attached, said cable having the first end of said cable attached to the piston before the cable proceeds from the side of the piston which is nearer the first end of the housing, along the bore of the housing, through the first aperture, along the exterior of the housing, through the second aperture, and again along the bore of the housing until said cable enters the piston from the side of the piston which is farther from the first end of the housing and has the second end of said cable attached to the first end of said cable;

a first input valve, connected to the housing near the first end of said housing and communicating with the bore of said housing, for introducing compressed gas into the bore and thereby forcing the piston toward the second end of the housing and, consequently, forcing the object or objects that have been attached to the cable toward the first end of the housing until the object or objects have reached a desired height;

an exhaust valve attached to the housing and communicating with the bore between the first input valve and the second end of the housing, which exhaust valve is opened to permit gas to exit from the bore of the housing as the piston moves toward the exhaust valve, closed as the piston passes said exhaust valve moving toward the second end of the housing, and opened when it is desired to permit gas between the piston and the first end of the housing to escape in order to permit the piston to move toward the first end of the housing and the object or objects to descend; and a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, which deceleration control valve is adjusted to allow gas to escape from the bore at such a rate as gives the desired descent speed for the object or objects once the piston has reached the exhaust valve during the travel of the piston toward the first end of the housing.

2. The device for accelerating and decelerating one or more objects as recited in claim 1, further comprising:

a first pulley around which the cable passes after having exited the housing through the first aperture but before said cable proceeds along the exterior of the housing;

a second pulley around which the cable passes after proceeding along the exterior of the housing but before passing through the second aperture into the bore; and a carrier to hold the object or objects, rather than simply having the cable available to be connected to the object or objects directly, which carrier is attached to the cable in such a manner that the carrier will be near the second end of the housing when the piston is near the first end of the housing and, consequently, so that the carrier will be near the first end of the housing when the piston is near the second end of the housing.

3. The device for accelerating and decelerating one or more objects as recited in claim 2, further comprising:

a container for pressurized gas connected to and communicating with the first input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

4. The device for accelerating and decelerating one or more objects as recited in claim 3, further comprising:

a means for retention connected to the housing near the first end of the housing to retain the carrier at the location of the retention means and thereby enhance the anticipation of a participant or participants prior or even subsequent to the re-opening of the exhaust valve.

5. The device for accelerating and decelerating one or more objects as recited in claim 4, further comprising:

a means for retention connected to the housing near the first end of the housing to retain the carrier at the location of the retention means and thereby enhance the anticipation of a participant or participants prior or even subsequent to the re-opening of the exhaust valve.

6. The device for accelerating and decelerating one or more objects as recited in claim 1, further comprising:

a container for pressurized gas connected to and communicating with the first input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

7. The device for accelerating and decelerating one or more objects as recited in claim 6, further comprising:

a means for retention connected to the housing near the first end of the housing to retain the carrier at the location of the retention means and thereby enhance the anticipation of a participant or participants prior or even subsequent to the re-opening of the exhaust valve.

8. The device for accelerating and decelerating one or more objects as recited in claim 1, further comprising:

a means for retention connected to the housing near the first end of the housing to retain the carrier at the location of the retention means and thereby enhance the anticipation of a participant or participants prior or even subsequent to the re-opening of the exhaust valve.

9. A device for accelerating and decelerating one or more objects, which comprises:

a housing containing a bore, having a first aperture near the first end of said housing, and having a second aperture near the second end of said housing;

a piston slidably mounted within the bore of said housing;

a cable to which the object or objects can be attached, said cable having the first end of said cable attached to the piston before the cable proceeds from the side of the piston which is nearer the first end of the housing, along the bore of the housing, through the first aperture, along the exterior of the housing, through the second aperture, and again along the bore of the housing until said cable enters the piston from the side of the piston which is farther from the first end of the housing and has the second end of said cable attached to the first end of said cable;

a first input valve, connected to the housing near the first end of said housing and communicating with the bore of said housing, for introducing compressed gas into the bore and thereby forcing the piston toward the second end of the housing and, consequently, forcing the object or objects that have been attached to the cable toward the first end of the housing until the object or objects have reached a desired distance from the first end of the housing;

a second input valve connected to the housing near the second end of said housing and communicating with the bore of said housing, for introducing compressed gas into the bore and thereby forcing the piston toward the first end of the housing and, consequently, forcing the object or objects that have been attached to the cable toward the first end of the housing once the object or objects have reached the desired distance from the first end of the housing;

an exhaust valve attached to the housing and communicating with the bore between said first input valve and said second input valve, which exhaust valve is opened to permit gas to exit from the bore of the housing whenever the piston moves toward the exhaust valve and closed as the piston passes said exhaust valve and whenever the piston is moving away from the exhaust valve permitting the injected gas to have full effect; and a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, which deceleration control valve is kept closed when it is desired to have the piston and, consequently, the object or objects rebound through the compression and subsequent expansion of gas in the first end of the bore and which deceleration valve is adjusted to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

10. The device for accelerating and decelerating one or more objects as recited in claim 9, further comprising:

a first pulley around which the cable passes after having exited the housing through the first aperture but before said cable proceeds along the exterior of the housing;

a second pulley around which the cable passes after proceeding along the exterior of the housing but before passing through the second aperture into the bore; and a carrier to hold the object or objects, rather than simply having the cable available to be connected to the object or objects directly, which carrier is attached to the cable in such a manner that the carrier will be near the second end of the housing when the piston is near the first end of the housing and, consequently, so that the carrier will be near the first end of the housing when the piston is near the second end of the housing.

11. The device for accelerating and decelerating one or more objects as recited in claim 10, further comprising:

a container for pressurized gas connected to and communicating with the first input valve and the second input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

12. The device for accelerating and decelerating one or more objects as recited in claim 11, further comprising:

a means for retention connected to the housing near the first end of the housing to retain the carrier at the location of the retention means and thereby enhance the anticipation of a participant or participants prior or even subsequent to the re-opening of the exhaust valve.

13. The device for accelerating and decelerating one or more objects as recited in claim 12, further comprising:

a means for retention connected to the housing near the first end of the housing to retain the carrier at the location of the retention means and thereby enhance the anticipation of a participant or participants prior or even subsequent to the re-opening of the exhaust valve.

14. The device for accelerating and decelerating one or more objects as recited in claim 9, further comprising:

a container for pressurized gas connected to and communicating with the first input valve and the second input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

15. The device for accelerating and decelerating one or more objects as recited in claim 14, further comprising:

a means for retention connected to the housing near the first end of the housing to retain the carrier at the location of the retention means and thereby enhance the anticipation of a participant or participants prior or even subsequent to the re-opening of the exhaust valve.

16. The device for accelerating and decelerating one or more objects as recited in claim 9, further comprising:

a means for retention connected to the housing near the first end of the housing to retain the carrier at the location of the retention means and thereby enhance the anticipation of a participant or participants prior or even subsequent to the re-opening of the exhaust valve.

17. A device for accelerating and decelerating one or more objects, which comprises:

a housing containing a bore, having a first aperture near the first end of said housing, and having a second aperture near the second end of said housing;

a piston slidably mounted within the bore of said housing;

a cable to which the object or objects can be attached, said cable having the first end of said cable attached to the piston before the cable proceeds from the side of the piston which is nearer the first end of the housing, along the bore of the housing, through the first aperture, along the exterior of the housing, through the second aperture, and again along the bore of the housing until said cable enters the piston from the side of the piston which is farther from the first end of the housing and has the second end of said cable attached to the first end of said cable;

a first input valve, connected to the housing near the first end of said housing and communicating with the bore of said housing, for introducing compressed gas into the bore and thereby forcing the piston toward the second end of the housing and, consequently, forcing the object or objects that have been attached to the cable toward the first end of the housing until the object or objects have reached a desired distance from the first end of the housing;

a second input valve connected to the housing near the second end of said housing and communicating with the bore of said housing, for introducing compressed gas into the bore and thereby forcing the piston toward the first end of the housing and, consequently, forcing the object or objects that have been attached to the cable toward the first end of the housing once the object or objects have reached the desired distance from the first end of the housing; and a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, which deceleration control valve is kept closed when it is desired to have the piston and, consequently, the object or objects rebound through the compression and subsequent expansion of gas in the first end of the bore and which deceleration valve is adjusted to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

18. The device for accelerating and decelerating one or more objects as recited in claim 17, further comprising:

a first pulley around which the cable passes after having exited the housing through the first aperture but before said cable proceeds along the exterior of the housing;

a second pulley around which the cable passes after proceeding along the exterior of the housing but before passing through the second aperture into the bore; and a carrier to hold the object or objects, rather than simply having the cable available to be connected to the object or objects directly, which carrier is attached to the cable in such a manner that the carrier will be near the second end of the housing when the piston is near the first end of the housing and, consequently, so that the carrier will be near the first end of the housing when the piston is near the second end of the housing.

19. The device for accelerating and decelerating one or more objects as recited in claim 18, further comprising:

a container for pressurized gas connected to and communicating with the first input valve and the second input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

20. The device for accelerating and decelerating one or more objects as recited in claim 19, further comprising:

a means for retention connected to the housing near the first end of the housing to retain the carrier at the location of the retention means and thereby enhance the anticipation of a participant or participants prior or even subsequent to the re-opening of the exhaust valve.

21. The device for accelerating and decelerating one more objects as recited in claim 20, further comprising:

a means for retention connected to the housing near the first end of the housing to retain the carrier at the location of the retention means and thereby enhance the anticipation of a participant or participants prior or even subsequent to the re-opening of the exhaust valve.

22. The device for accelerating and decelerating one or more objects as recited in claim 17, further comprising:

a container for pressurized gas connected to and communicating with the first input valve and the second input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

23. The device for accelerating and decelerating one or more objects as recited in claim 22, further comprising:

a means for retention connected to the housing near the first end of the housing to retain the carrier at the location of the retention means and thereby enhance the anticipation of a participant or participants prior or even subsequent to the re-opening of the exhaust valve.

24. The device for accelerating and decelerating one or more objects as recited in claim 17, further comprising:

a means for retention connected to the housing near the first end of the housing to retain the carrier at the location of the retention means and thereby enhance the anticipation of a participant or participants prior or even subsequent to the re-opening of the exhaust valve.

25. A device for accelerating and decelerating one or more objects, which comprises:

a housing containing a bore, having a first aperture near the first end of said housing, having a second aperture near the second end of said housing, and having a third aperture between the first end of said housing and the second end of said housing;

a piston slidably mounted within the bore of said housing which forces gas through the third aperture as said piston moves toward the third aperture;

a cable to which the object or objects can be attached, said cable having the first end of said cable attached to the piston before the cable proceeds from the side of the piston which is nearer the first end of the housing, along the bore of the housing, through the first aperture, along the exterior of the housing, through the second aperture, and again along the bore of the housing until said cable enters the piston from the side of the piston which is farther from the first end of the housing and has the second end of said cable attached to the first end of said cable;

a first input valve, connected to the housing near the first end of said housing and communicating with the bore of said housing, for introducing compressed gas into the bore so rapidly that the piston is forced toward the second end of the housing and, consequently, forcing the object or objects that have been attached to the cable toward the first end of the housing, with such speed that the piston so quickly passes the third aperture that significant gas remains between the piston and the second end of the housing and the kinetic energy of the system is so great that the piston compresses the gas in the second end of the housing until such kinetic energy is exhausted and the pressure in the second end of the housing combined with any component of weight from the object or objects which is parallel to the bore of the housing and directed toward the second end of the housing forces the piston toward the first end of the housing, where compression and expansion of the gas again occurs; and a deceleration control valve connected to the housing and communicating with the bore of the housing near the first end of said housing and closer to the first end of said housing than the third aperture but sufficiently far from such first end of said housing that the quantity of gas between said deceleration control valve and the first end of the housing would be adequate to bring the piston to a cushioned stop should such deceleration control valve stick in a fully open position, which deceleration control valve is kept closed when it is desired to have the piston and, consequently, the object or objects rebound through the compression and subsequent expansion of gas in the first end of the bore and which deceleration valve is adjusted to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

26. The device for accelerating and decelerating one or more objects as recited in claim 25, further comprising:

a first pulley around which the cable passes after having exited the housing through the first aperture but before said cable proceeds along the exterior of the housing;

a second pulley around which the cable passes after proceeding along the exterior of the housing but before passing through the second aperture into the bore; and a carrier to hold the object or objects, rather than simply having the cable available to be connected to the object or objects directly, which carrier is attached to the cable in such a manner that the carrier will be near the second end of the housing when the piston is near the first end of the housing and, consequently, so that the carrier will be near the first end of the housing when the piston is near the second end of the housing.

27. The device for accelerating and decelerating one or more objects as recited in claim 26, further comprising:

a container for pressurized gas connected to and communicating with the first input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

28. The device for accelerating and decelerating one or more objects as recited in claim 25, further comprising:

a container for pressurized gas connected to and communicating with the first input valve;

a compressor attached to and communicating with said container for pressurized gas to take air from the atmosphere, compress such air, and supply such pressurized air to said container; and an extension connected to the second end of said housing to increase the volume of the bore at said second end of the housing and thereby to decrease the tendency to have a reduction in gas pressure created in the bore at the second end of the housing as the piston moves away from the second end of the housing.

29. A device for accelerating and decelerating one or more objects, which comprises:

a housing containing a bore, having a first aperture near the first end of said housing, and having a second aperture near the second end of said housing;

a piston slidably mounted within the bore of said housing;

a cable to which the object or objects can be attached, said cable having the first end of said cable attached to the piston before the cable proceeds from the side of the piston which is nearer the first end of the housing, along the bore of the housing, through the first aperture, along the exterior of the housing, through the second aperture, and again along the bore of the housing until said cable enters the piston from the side of the piston which is farther from the first end of the housing and has the second end of said cable attached to the first end of said cable;

a first input valve, connected to the housing near the first end of said housing and communicating with the bore of said housing, for introducing compressed gas into the bore and thereby forcing the piston toward the second end of the housing and, consequently, forcing the object or objects that have been attached to the cable toward the first end of the housing until the object or objects have reached a desired distance from the first end of the housing;

a second input valve connected to the housing near the second end of said housing and communicating with the bore of said housing, for introducing compressed gas into the bore and thereby forcing the piston toward the first end of the housing and, consequently, forcing the object or objects that have been attached to the cable toward the first end of the housing once the object or objects have reached the desired distance from the first end of the housing;

an exhaust valve attached to the housing and communicating with the bore between said first input valve and said second input valve, which exhaust valve is opened when it is desired to permit gas to exit from the bore of the housing;

a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, which deceleration control valve is kept closed when it is desired to have the piston and, consequently, the object or objects rebound through the compression and subsequent expansion of gas in the first end of the bore and which deceleration valve is adjusted to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects;

a first pulley around which the cable passes after having exited the housing through the first aperture but before said cable proceeds along the exterior of the housing;

a second pulley around which the cable passes after proceeding along the exterior of the housing but before passing through the second aperture into the bore;

a carrier to hold the object or objects, rather than simply having the cable available to be connected to the object or objects directly, which carrier is attached to the cable in such a manner that the carrier will be near the second end of the housing when the piston is near the first end of the housing and, consequently, so that the carrier will be near the first end of the housing when the piston is near the second end of the housing;

a container for pressurized gas connected to and communicating with the first input valve and the second input valve;

a compressor attached to and communicating with said container for pressurized gas to take air from the atmosphere, compress such air, and supply such pressurized air to said container;

an extension connected to the second end of said housing to increase the volume of the bore at said second end of the housing and thereby to decrease the tendency to have a reduction in gas pressure created in the bore at the second end of the housing as the piston moves away from the second end of the housing;

a means for retention connected to the housing near the first end of the housing to retain the carrier at the location of the retention means and thereby enhance the anticipation of a participant or participants prior or even subsequent to the re-opening of the exhaust valve; and a computer that is electrically connected to said first input valve, said second input valve, said deceleration control valve, and said exhaust valve to control said first input valve, said second input valve, said deceleration control valve, and said exhaust valve to control.

30. A process for accelerating and decelerating one or more objects, which comprises:

placing the object or objects into a carrier that connected to a cable, the first end of which cable is attached to a piston slidably mounted within the bore of a housing before said cable proceeds from the side of the piston which is nearer to a first end of the housing, along the bore of the housing, through a first aperture which is in the first end of the housing, along the exterior of the housing, through a second aperture which is in the second end of the housing, and again along the bore of the housing until the cable enters the piston from the side of the piston which is farther from the first end of the housing and the second end of the cable is attached to the first end of the cable, so that the carrier is near the second of the housing when the pulley is near the first end of the housing;

injecting gas into the bore near the first end of the housing to force the piston a desired distance toward the second end of the housing;

allowing gas to be forced from an exhaust valve in the housing between the point of injection of the gas and the second end of the housing when the piston moves toward the exhaust valve;

closing the exhaust valve as the piston passes the exhaust valve moving toward the second end of the housing;

opening the exhaust valve when it is desired to permit gas between the piston and the first end of the housing to escape in order to permit the piston to move toward the first end of the housing and the carrier to descend; and adjusting a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, to allow gas to escape from the bore at such a rate as gives the desired descent speed for the object or objects once the piston has reached the exhaust valve during the travel of the piston toward the first end of the housing.

31. A process for accelerating and decelerating one or more objects, which comprises:

placing the object or objects into a carrier that is connected to a cable, the first end of which cable is attached to a piston slidably mounted within the bore of a housing before said cable proceeds from the side of the piston which is nearer to a first end of the housing, along the bore of the housing, through a first aperture which is in the first end of the housing, along the exterior of the housing, through a second aperture which is in the second end of the housing, and again along the bore of the housing until the cable enters the piston from the side of the piston which is farther from the first end of the housing and the second end of the cable is attached to the first end of the cable, so that the carrier is near the second of the housing when the pulley is near the first end of the housing;

injecting gas into the bore near the first end of the housing to force the piston a desired distance toward the second end of the housing;

allowing gas to be forced from an exhaust valve in the housing between the point of injection of the gas and the second end of the housing when the piston moves toward the exhaust valve;

closing the exhaust valve as the piston passes the exhaust valve moving toward the second end of the housing;

once the piston has reached the desired distance toward the second end of the housing, injecting gas into the bore near the second end of the housing at a location closer to the second end of the housing than is the exhaust valve;

opening the exhaust valve to allow gas between the piston and the first end of the housing to escape until the piston reaches the exhaust valve in its movement toward the first end of the housing; and adjusting a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, to allow gas to escape from the bore at such a rate as gives the desired descent speed for the object or objects once the piston has reached the exhaust valve during the travel of the piston toward the first end of the housing.

32. A process for accelerating and decelerating one or more objects, which comprises:

placing the object or objects into a carrier that is connected to a cable, the first end of which cable is attached to a piston slidably mounted within the bore of a housing before said cable proceeds from the side of the piston which is nearer to a first end of the housing, along the bore of the housing, through a first aperture which is in the first end of the housing, along the exterior of the housing, through a second aperture which is in the second end of the housing, and again along the bore of the housing until the cable enters the piston from the side of the piston which is farther from the first end of the housing and the second end of the cable is attached to the first end of the cable, so that the carrier is near the second of the housing when the pulley is near the first end of the housing;

injecting gas into the bore near the first end of the housing to force the piston a desired distance toward the second end of the housing;

allowing gas to be forced from an exhaust valve in the housing between the point of injection of the gas and the second end of the housing when the piston moves toward the exhaust valve;

closing the exhaust valve as the piston passes the exhaust valve moving toward the second end of the housing;

once the piston has reached the desired distance toward the second end of the housing, injecting gas into the bore near the second end of the housing at a location closer to the second end of the housing than is the exhaust valve;

opening the exhaust valve to allow gas between the piston and the first end of the housing to escape until the piston reaches the exhaust valve in its movement toward the first end of the housing;

maintaining a deceleration control valve connected to the housing and communicating with the bore of the housing near the first end of said housing and closer to the first end of said housing than the exhaust valve but sufficiently far from such first end of said housing that the quantity of gas between said deceleration control valve and the first end of the housing would be adequate to bring the piston to a cushioned stop should such deceleration control valve stick in a fully open position, closed when it is desired to have the piston and, consequently, the object or objects rebound through the compression and subsequent expansion of gas in the first end of the bore; and adjusting the deceleration valve to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

33. A process for accelerating and decelerating one or more objects, which comprises:

placing the object or objects into a carrier that is connected to a cable, the first end of which cable is attached to a piston slidably mounted within the bore of a housing before said cable proceeds from the side of the piston which is nearer to a first end of the housing, along the bore of the housing, through a first aperture which is in the first end of the housing, along the exterior of the housing, through a second aperture which is in the second end of the housing, and again along the bore of the housing until the cable enters the piston from the side of the piston which is farther from the first end of the housing and the second end of the cable is attached to the first end of the cable, so that the carrier is near the second of the housing when the pulley is near the first end of the housing;

injecting gas into the bore near the first end of the housing to force the piston a desired distance toward the second end of the housing;

once the piston has reached the desired distance toward the second end of the housing, injecting gas into the bore near the second end of the housing;

maintaining a deceleration control valve connected to the housing and communicating with the bore of the housing near the first end of said housing but sufficiently far from such first end of said housing that the quantity of gas between said deceleration control valve and the first end of the housing would be adequate to bring the piston to a cushioned stop should such deceleration control valve stick in a fully open position, closed when it is desired to have the piston and, consequently, the object or objects rebound through the compression and subsequent expansion of gas in the first end of the bore; and adjusting the deceleration valve to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

34. A process for accelerating and decelerating one or more objects, which comprises:

placing the object or objects into a carrier that is connected to a cable, the first end of which cable is attached to a piston slidably mounted within the bore of a housing before said cable proceeds from the side of the piston which is nearer to a first end of the housing, along the bore of the housing, through a first aperture which is in the first end of the housing, along the exterior of the housing, through a second aperture which is in the second end of the housing, and again along the bore of the housing until the cable enters the piston from the side of the piston which is farther from the first end of the housing and the second end of the cable is attached to the first end of the cable, so that the carrier is near the second of the housing when the pulley is near the first end of the housing;

injecting gas into the bore near the first end of the housing so rapidly that the piston is forced toward the second end of the housing and, consequently, forces the carrier toward the first end of the housing, with such speed that the piston so quickly passes a third aperture in the bore between the first end of said housing and the second end of said housing that significant gas remains between the piston and the second end of the housing and the kinetic energy of the system is so great that the piston compresses the gas in the second end of the housing until such kinetic energy is exhausted and the pressure in the second end of the housing combined with any component of weight from the carrier and the object or objects which is parallel to the bore of the housing and directed toward the second end of the housing forces the piston toward the first end of the housing;

maintaining a deceleration control valve connected to the housing and communicating with the bore of the housing near the first end of said housing but sufficiently far from such first end of said housing that the quantity of gas between said deceleration control valve and the first end of the housing would be adequate to bring the piston to a cushioned stop should such deceleration control valve stick in a fully open position, closed when it is desired to have the piston and, consequently, the object or objects rebound through the compression and subsequent expansion of gas in the first end of the bore; and adjusting the deceleration valve to allow gas to escape at such a rate as gives the desired descent speed for the object or objects and to minimize rebounding of the piston and, consequently, the object or objects when the piston is moving toward the first end of the housing and it is desired to stop the motion of the piston and, consequently, the object or objects.

* * * * *